United States Patent [19]

Tamura

[11] Patent Number: 4,903,910

[45] Date of Patent: Feb. 27, 1990

[54] ROLL CORE RELEASING DEVICE

[75] Inventor: Hiromi Tamura, Kawasaki, Japan

[73] Assignee: Kabushiki Kaisha Tokyo Kikai Seisakusho, Tokyo, Japan

[21] Appl. No.: 258,837

[22] Filed: Oct. 17, 1988

[30] Foreign Application Priority Data

Oct. 30, 1987 [JP] Japan ..... 62-273170[U]

[51] Int. Cl.[4] ..... B65H 19/12

[52] U.S. Cl. ..... 242/81; 242/58.6; 242/68.4

[58] Field of Search ..... 242/81, 58, 58.6, 68.4, 242/79; 29/642

[56] References Cited

U.S. PATENT DOCUMENTS 3,695,532 10/1972 Lindstaedt ..... 242/79 X 4,131,206 12/1978 Kawada et al. ..... 242/79 X

*Primary Examiner*—Stuart S. Levy

*Assistant Examiner*—Steven M. duBois

*Attorney, Agent, or Firm*—Richard Bushnell

[57] ABSTRACT

In a rolled object holdiing apparatus whose holding members hold both ends of a roll core, a roll core releasing device comprises a core pushing mechanism which in turn consists of a core pushing member and a driving means for moving the core pushing member at least in the direction of radius of the core. The core pushing mechanism is either installed in a core receiving member or in a core holding member. Whether to operate the driving means for the core pushing member is controlled by a core detector in the core receiving member. With this construction, the core releasing device of the invention performs automatic and reliable releasing of the core from holding members of the rolled object holding apparatus, thus eliminating various problems experienced with conventional devices during automatic replacement of rolled objects.

3 Claims, 5 Drawing Sheets

ROLL CORE RELEASING DEVICE

BACKGROUND OF THE INVENTION

This is invention relates to a roll core releasing device which automatically and reliably releases an empty core of a rolled object from holding members of a rolled object holding apparatus such as a paper roll holding apparatus for a rotary press after the rolled object such as a paper roll on the core which is held at its ends on the holding members has been fed and then run out.

One example of the conventional device for releasing the empty core from the holding members, as used on a paper roll holding device for a rotary press, may be found in the Japanese Patent Publication No. 38496/1981 (line 42 of column 8 to line 4 of column 9). In this common example the holding members inserted into the hollow core from each side are retracted out of the hollow core to allow the core to fall by gravity, thus releasing the core from the holding members. In this case, only one of the holding members that hold the core from both sides is advanced into and retracted from the hollow core. When the distance between the opposed holding members exceeds the length of the core, the core falls by gravity (reference: "SHIMBUN INSATSU" (Newspaper Printing): vol. on Printing, revised edition, published by Nihon Shimbun Kyokai on Oct. 31, 1980 (p. 66 1.13 of right column to p. 67 1.6 of left column).

In recent years, growing efforts are being made to increase the printing speed of the rotary press and the diameter and volume of the paper roll. Because of these tendencies, inertia of the paper roll during the operation of the rotary press becomes larger and, to synchronize the rotation of the paper roll with the printing speed of the rotary press, it is necessary for holding members to give a secure and reliable restraining holding to paper roll.

For that purpose, the paper roll holding apparatus or rolled object holding apparatus employs a mechanism to increase the force of engagement of the holding members with the inner circumferential surface of the hollow core. The increased grip, however, has resulted in still retained engagement force between one of the holding members (generally the one which does not retract) and the inner circumferential surface of the hollow core often when the holding member has retracted and the distance between the opposed holding members has exceeded the length of the core, thus requiring manual work on the part of an operator to completely release the old core during the process of automatic replacement of the rolled object.

SUMMARY OF THE INVENTION

It is the primary object of the present invention to provide a roll core releasing device which eliminates problems during the automatic replacement of rolled objects in the rolled object holding apparatus whose holding members hold both ends of the roll core.

The roll core releasing device according to this invention comprises a core pushing mechanism which in turn consists of a core pushing member and a driving device for moving the core pushing member at least in the direction of radius of the core. The core pushing mechanism is installed either in the core receiving member or in the core holding member. It is preferably that whether to operate the driving device for the core pushing member be controlled by a core detector in the core receiving member.

In conventional roll core releasing devices, the core is held at both ends by the holding members and when it is to be released from the rolled object holding apparatus, the distance between the opposed holding members is made larger than the length of the core so that it is released from the holding members and falls onto the core receiving member.

However, because the core is firmly gripped by the holding members, the core may fail to disengage from one of the holding members and to fall onto the core receiving member even when the distance between the opposed holding member is larger than the length of the core. When the core fails to drop and the core detector does not detect the core on the core receiving member, the above-mentioned core releasing device is activated.

In the roll core releasing device, a core pushing member is moved by a driving device in at least the direction of radius of the core to push the core in the radial direction, rotating the core about the holding member with which it remains engaged until it is separated from that holding member. Thus, the core is completely disengaged from the roll core holding member, falling onto the core receiving member.

BRIEF DESCRIPTION OF THE DRAWINGS

Other feature and advantages of the present invention will be apparent from the following description taken in connection with the accompanying drawings, wherein.

DESCRIPTION OF THE PREFERRED EMBODIMENTS

Embodiments of this invention will now be described by referring to the attached drawings.

Figure 9:
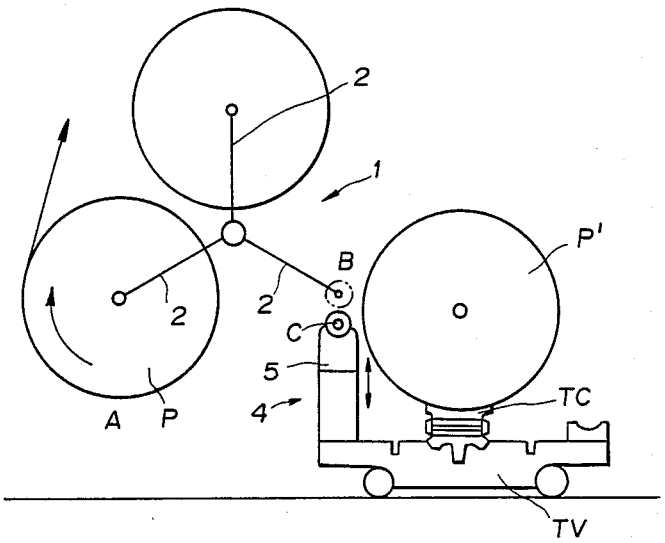
FIG. 9 is a schematic diagram showing a paper roll holding apparatus and an automatic paper roll replacing apparatus to which the roll core releasing device of this invention is applied.

The roll core releasing device, as shown in FIG. 9, is used on a paper roll holding apparatus for a rotary press. When a paper roll on a core C has run out (though a small amount of paper is still remaining on the core), the core C which is held at its ends by core holding shafts 3 mounted at the ends of a pair of arms 2 of a spider 1 (with 120-degree central angles) in the paper roll holding apparatus is released from the core holding shafts 3 onto a core receiver 5 which is mounted vertically movable on an automatic paper roll replacing apparatus 4.

Figure 10:
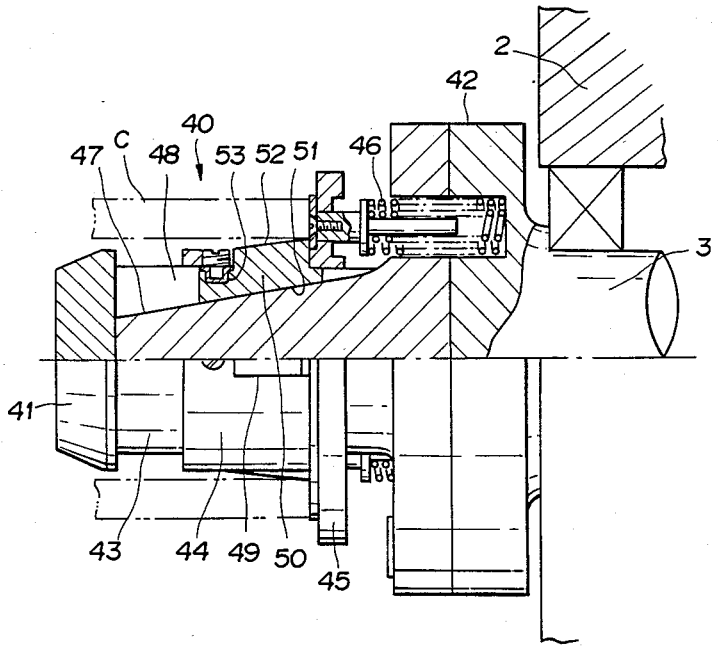
FIG. 10 is a cross section of a core holder at the end of a core holding shaft on a spider.

First we will describe a core holder 40 mounted at the end of each of the core holding shafts 3, a mechanism to amplify the force of engagement with the inner circumference of the hollow core. The core holder 40 has a structure as shown in FIG. 10.

At the front end of the core holding shaft 3, a front stopper 41 and a rear flange 42 are formed. An intermediate shaft portion 43 between the stopper 41 and the flange 42 has a sliding ring 44 mounted thereon. A compression spring 46 is interposed between the back of a flange 45 of the sliding ring 44 and the flange 42 of the core holding shaft 3 to urge the sliding ring 44 toward the front stopper 41.

The intermediate shaft portion 43 has a specified number (say, four) of axial grooves 48 whose bottom surfaces 47 are inclined downwardly toward the front. The sliding ring 44 has openings 49 cut therein corresponding to the grooves 48. In the axial grooves 48 and the openings 49 there are installed sliding claws 50 which are slidable along the axial grooves 48 so that they have radial displacements. The sliding claws 50 are so formed that its inner surface 51 is in contact with the bottom surfaces 47 of the grooves 48 and that their outer surfaces 52 project from the outer circumferential surface of the sliding ring 44. The sliding claws 50 are pressed inwardly by the sliding ring 44 through a compression spring 53.

Figure 1:
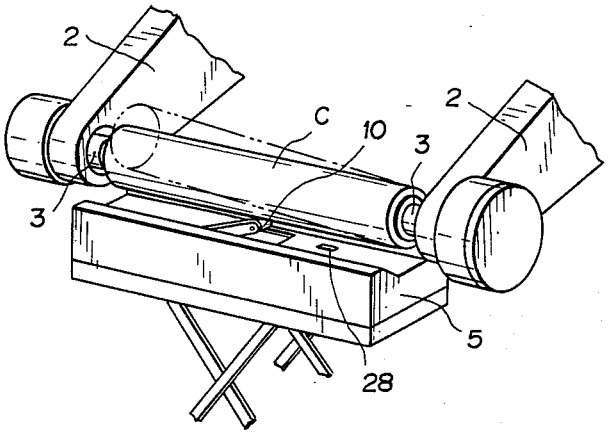
FIG. 1 is a perspective view of the roll core releasing device as a first embodiment of the invention.
Figure 6:
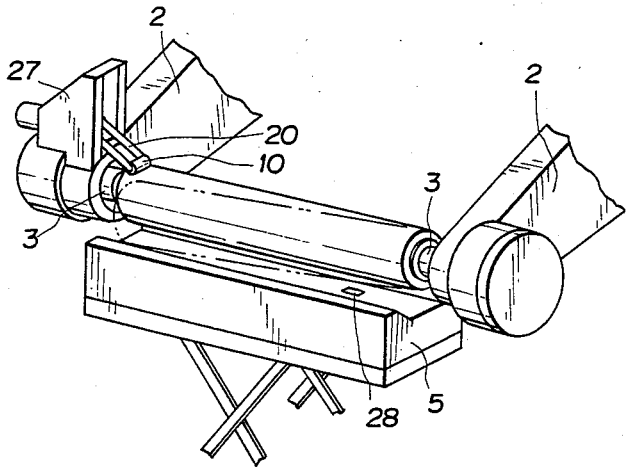
FIG. 6 is a perspective view of the roll core releasing device as a second embodiment of the invention.

The roll core releasing device are available in two types: one provided on the core receiver 5 as shown in FIG. 1 and the other provided at the ends of the arms 2 of the spider 1 as shown in FIG. 6.

Figure 2:
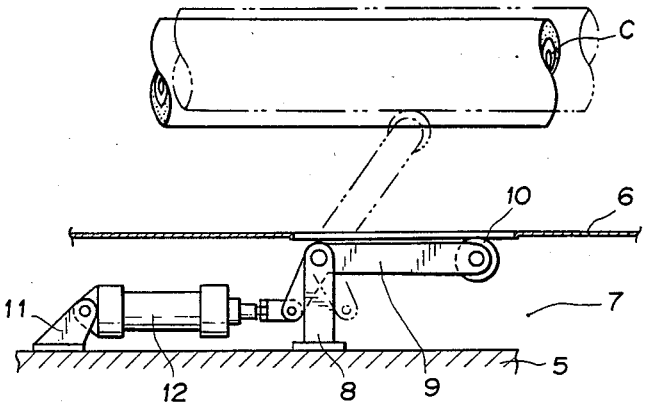
FIG. 2 is a partial view of a first example of the roll core releasing device of FIG. 1.

As to the roll core releasing device mounted on the core receiver 5, FIG. 2 shows a first example of this type. In a space 7 enclosed by a housing 6 of the core receiver 5, a bracket 8 is installed on which a bell crank lever 9 is mounted pivotable about an axis perpendicular to the core axis. The bell crank lever 9 has a core pushing member (say, a rotatable roller) at the free end and, at the other end, is connected to a driving means, i.e., a hydraulic cylinder 12 which is pivotably mounted to a bracket 11 on the core receiver 5, as with the bracket 8, and which is operated in the direction of the core axis.

Figure 3:
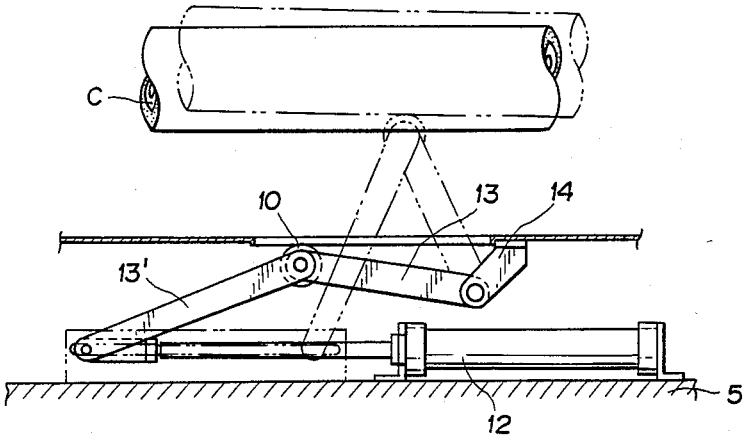
FIG. 3 is a partial view of a second example of the roll core releasing device of FIG. 1.

FIG. 3 shows a second example of the first type. Of two links 13, 13' that are provided with the core pushing member 10, the link 13 is pivotably connected at one end to a bracket 14 which is installed on the underside of the core receiver housing 6. The other link 13' is coupled at one end to the hydraulic cylinder 12.

Figure 4:
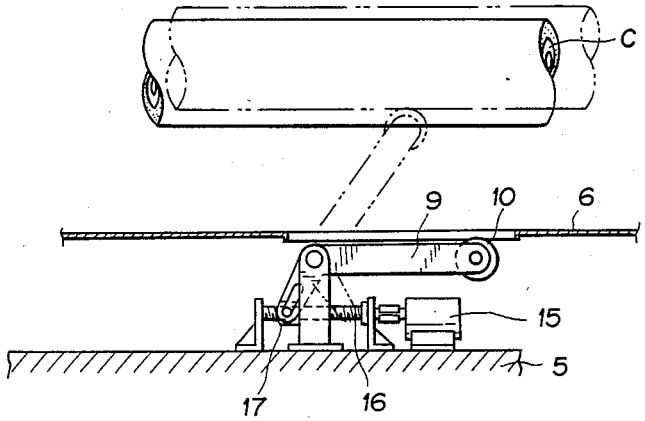
FIG. 4 and FIG. 5 are partial views of variations of the first and second examples, respectively.
Figure 5:
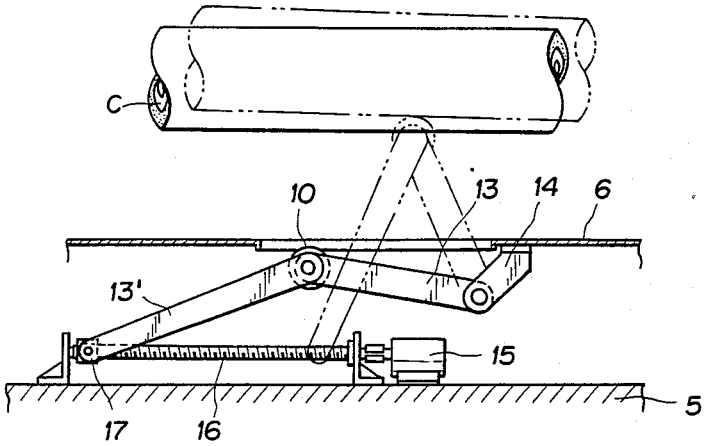

In the above two examples, the hydraulic cylinder 12 are used as a driving means. This driving means may be replaced with a motor and the associated mechanism installed in the space 7 enclosed by the housing 6 of the core receiver 5 as shown in FIG. 4 and 5. In these examples, a nut member 17 is screwed over a threaded shaft 16 which is driven by a motor 15 about the axis of the core, and the end of the bell crank lever 9 or the end of a link 13' may be pivotably connected to the nut member 17.

FIG. 6 shows the roll core releasing device of a type that is mounted at the ends of the arms 2 of the spider 1. Generally, one of the opposed core holding shafts 3 is made retractable in the axial direction. In this type, the failure of the core to disengage from the core holding shafts 3 and fall when the core holding shaft has retracted and the distance between the two core holding shafts has exceeded the length of the core C occurs at the core holder 40 of the another core holding shaft 3 that is not retracted. Therefore, the core releasing device is installed at the end of the arm 2 on the side of the core holding shaft 3 that is made retractable.

Where the core holding shaft 3 from which the core will fail to disengage is not predetermined, as when both of the opposed core holding shafts 3 are retracted in the axial direction, the core releasing device should be mounted at the ends of both opposed arms 2. In this case it is preferable to provide a structure in which one of the core releasing device is activated that is mounted on the side of the core holding shaft from which the core has disengaged as a result of the retraction of the core holding shafts. However, both of the devices may be activated at the same time.

Figure 7:
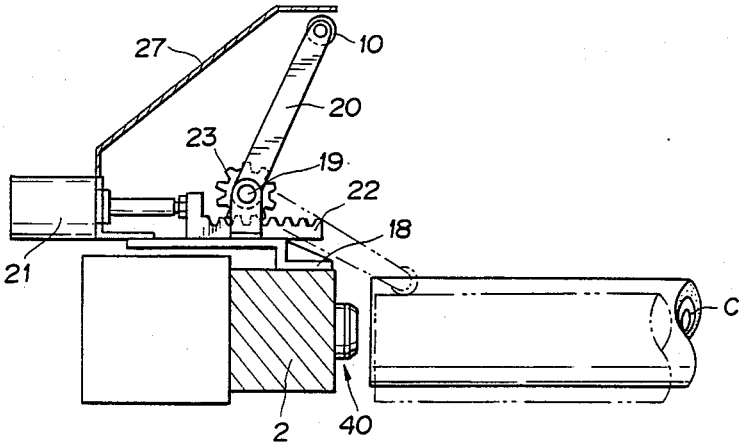
FIG. 7 is a partial view of the roll core releasing device of FIG. 6.

FIG. 7 shows a first example of the second type. On a bracket 18 mounted at the end of the arm 2 is rotatably held a shaft 19 which is rotatable about an axis perpendicular to the core axis. The base end of a rotating lever 20 which has the core pushing member (say, a rotatable roller) 10 at the free end is securely fixed to the rotatable shaft 19. The rotatable shaft 19 is connected with a driving means. That is, the rotatable shaft 19 is securely provided with a pinion 23 that is in mesh with a rack 22 which is mounted on the bracket 18 and connected with a hydraulic cylinder 21. The hydraulic cylinder 21 is operated in the axial direction.

Figure 8:
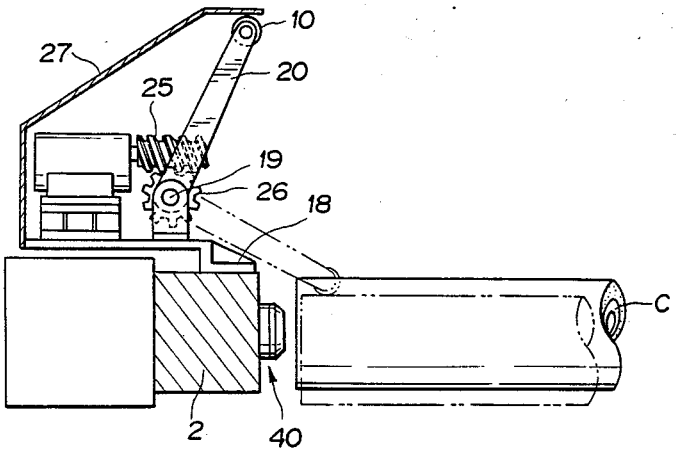
FIG. 8 is a partial view of a variation of the roll core releasing device of FIG. 6.

The rack and pinion mechanism as a driving means in the above example may be replaced with the construction as shown in FIG. 8. In this construction a worm 25 mounted on the bracket 18 is turned by a motor 24 about the core axis and a worm wheel 26 in mesh with the worm 25 is secured to the rotatable shaft 19. The core releasing device of a type that is mounted on the end of the arm 2 of the spider 1 is enclosed by a cover 27 secured to the bracket 18.

In both of the above two types of the roll core releasing devices, a core detector 28 is installed on the upper surface of the housing 6 of the core receiver 5, as shown in FIGS. 1 and 6, to identify whether the core C is on the core receiver housing 6 after the core holding shafts 3 are retracted during the core release operation. When the core C is detected on the core receiver housing 6, the core releasing operation is disabled.

Now, the action of the core releasing device will be explained.

In FIG. 9, the paper rolls P are mounted on the arms 2 of the spider 1. The core C is held by the core holding shafts 3 and held by the core holders 40 (see FIG. 10) at the ends of the core holding shafts 3. The detail is explained in the following.

The front end of the core holding shaft 3 is inserted into a hollow of the core C. The flange 45 of the sliding ring 44 is pushed by the end of the core C against the force of the compression spring 46, so that the sliding ring 44 retracts together with the sliding claws 50. As the sliding claws 50 retract, the inclined bottom surfaces 47 of the grooves 48 with which the inner surfaces 51 of the sliding claws 50 are in contact cause the sliding claws 50 to project radially outwardly against the force of the compression spring 53, bringing the outer surfaces 52 of the claws 50 into pressing contact with the inner circumferential surface of the hollow core C. As a result the core C is firmly gripped.

After the paper roll P fitted to the arms 2 has run out as a result of feeding at the feeding position A, the empty core C is replaced with a new paper roll P' on the truck TC of the automatic paper roll replacing apparatus 4. At this time, the spider 1 is rotated counterclockwise on the drawing to bring the arms 2 to the replacing position B. At the same time, the traverser TV of the automatic paper roll replacing apparatus is moved to set the core receiver 5 to a position immediately below the core C—which is at the position B—and the core receiver 5 is then raised to the receiving position.

In this condition, one or both of the opposed core holding shafts 3 on the arms 2 is retracted to increase the distance between them.

As the core holder 40 at the end of the core holding shaft 3 comes out of the hollow core C, the flange 45 of the sliding ring 44 is pushed forward by the force of the compression spring 46, carrying with it the sliding claws 50. Because its inner surfaces 51 follow the inclined bottom surfaces 47 of the grooves 48, the sliding claws 50 retract radially inwardly, disengaging its outer surfaces 52 from the inner circumferential surface of the hollow core C, with the result that the core C is released from the core holder 40.

Then when the distance between the opposed core holding shafts 3 exceeds the length of the core C, the core C is released from the core holding shafts 3, falling onto the housing 6 of the core receiver 5, at which time the normal release of the core C is detected by the core detector 28.

However, there are cases where the outer surfaces 52 of the sliding claws 50 in the core holder 40 do not disengage from the inner circumferential surface of the hollow core C which therefore does not come off the core holding shafts 3 because of the large pressing force of the sliding claws 50 of the core holder 40 against the inner circumferential surface of the hollow core C. That is, although the core holding shaft 3 is retracted, the core C does not fall onto the housing 6 of the core receiver 5. In this case the core detector 28 does not detect the normal falling of the core C.

When the core detector 28 fails to detect the presence of the core C, the core releasing device is activated.

The action of the roll core releasing device of the type shown in FIG. 1 will be explained. In the core releasing device of FIGS. 2 and 4, as the piston rod is pushed forward by the hydraulic cylinder 12 or as the nut member 17 is moved to the right by the rotation of the threaded shaft 16 driven by the motor 15, the bell crank lever 9 is rotated counterclockwise and the core pushing member 10 at the front end of the lever 9 pushes up the intermediate portion of the core C (as indicated by a two-dot chain line).

As for the roll core releasing devices shown in FIGS. 3 and 5, as the piston rod is retracted by the hydraulic cylinder 12 or as the nut member 17 is moved to the right by the rotation of the threaded shaft 16 driven by the motor 15, the two links 13, 13' are folded causing the core pushing member 10 at the joint of the links to push up the intermediate portion of the core C (indicated by a two-dot chain line).

The action of the roll core releasing device of the type shown in FIG. 6 is explained. In the core releasing devices of FIGS. 7 and 8, as the piston rod is retracted by the hydraulic cylinder 21 to move the rack 22 to the left and thereby rotate the pinion 23 or as the worm wheel 26 is rotated by the worm 25 driven by the motor 24, the rotatable shaft 19 or the rotatable lever 20 is turned clockwise causing the core pushing member 10 at the front end of the lever 20 to push down the core C at a point near the end that has disengaged from the core holding shaft 3.

Where the core releasing device is provided to both of the ends of the paired arms 2, either the core releasing device on the side of the core holding shaft from which the core has disengaged is activated or the two devices on both sides are activated at the same time.

In any of the aforementioned types of the core releasing devices, the push-up or push-down action of the core pushing member 10 against the core C causes the core C to rotate about the core holder 40 on the core holding shaft 3 with which it remains engaged, so that the outer surfaces 52 of the sliding claws 50 are reliably disengaged from the inner circumferential surface of the hollow core C. Then, the core C comes off both of the opposed core holding shafts 3 and falls onto the housing 6 of the core receiver 5, at which time the core detector 28 detects the normal release of the core C.

If a roller is used for the core pushing member 10, the core releasing action is not affected by the axial displacement component of the push member 10.

While the above embodiments represent the case where the devices is applied to the paper roll holding apparatus for a rotary press, it may also be used on other rolled object holding apparatus.

With the core releasing device according to the invention, after the paper web rolled on the core has been fed and run out, the core can reliably be released from the rolled object holding apparatus such as a paper roll holding apparatus eben when the core is still firmly gripped by the core holding members of the rolled object holding apparatus. The devices thus permits an automatic replacement of rolled objects without the need for manual work when releasing the core from the core holding members.

While the invention has been particularly shown and described with reference to preferred embodiments thereof, it will be understood by those skilled in the art that the foregoing and other changes in form and details can be made therein without departing from the spirit and scope of the invention.

What is claimed is:

1. In a rolled object holding apparatus whose holding members hold both ends of a roll core in combination with a core receiving member for receiving the empty core, a roll core releasing device comprising a core pushing mechanism, the core pushing mechanism further comprising:

a core pushing member; and a driving means for moving the core pushing member at least in the direction of radius of the core, said core pushing mechanism being mounted on said core receiving member.

2. In a rolled object holding apparatus whose holding members hold both ends of a roll, a core releasing device comprising a core pushing mechanism, the core pushing mechanism further comprising a core pushing member; and a driving means for moving said core pushing member at least in the direction of radius of the core, said core pushing mechanism being mounted on a one of said holding members.

3. The roll core releasing device as set forth in either claim 1 or 2, wherein the driving means is controlled by a core detector in the core receiving member.

* * * * *